United States Patent [19]

Hallqvist et al.

[11] 4,393,748

[45] Jul. 19, 1983

[54] DEVICE FOR STRIPPER

[75] Inventors: Sten Hallqvist; Erik Eriksson, both of Karlskoga, Sweden

[73] Assignee: Aktiebolaget Bofors, Bofors, Sweden

[21] Appl. No.: 217,595

[22] Filed: Dec. 18, 1980

[30] Foreign Application Priority Data

Dec. 18, 1979 [SE] Sweden ..... 7910442

[51] Int. Cl.[3] ..... F41F 9/06

[52] U.S. Cl. ..... 89/47; 89/20 R

[58] Field of Search ..... 89/20 R, 20 A, 21, 47

[56] References Cited

U.S. PATENT DOCUMENTS

| | | | |
|---|---|---|---|
| 811,797 | 2/1906 | Schneider | 89/47 |
| 4,135,433 | 1/1979 | Hultgren et al. | 89/47 |
| 4,183,281 | 1/1980 | Hultgren et al. | 89/47 |

*Primary Examiner*—Stephen C. Bentley

*Attorney, Agent, or Firm*—Pollock, Vande Sande & Priddy

[57] ABSTRACT

A stripper (5) is arranged at a breech ring of a large-calibre firearm. A ramming unit is arranged to insert a shell (11) and a charge (10) into the bore and chamber of the firearm during an insertion process. During the extraction process of the ramming unit which follows the insertion process the stripper goes into coaction with the bag charge and retains this in the chamber position. The stripper coacts with blocking means which during at least part of the insertion process prevent the stripper from being turned out. At a predetermined insertion position the ramming unit (12) achieves a releasing of the blocking means and at the releasing of the latter the stripper is released and can assume a turned-out position. The stripper is actuated to the turned-in position by means of a closing mechanism, and during this actuation the blocking means are prepared to again retain the stripper in the turned-in position at a renewed ramming.

7 Claims, 3 Drawing Figures

FIG. 1a
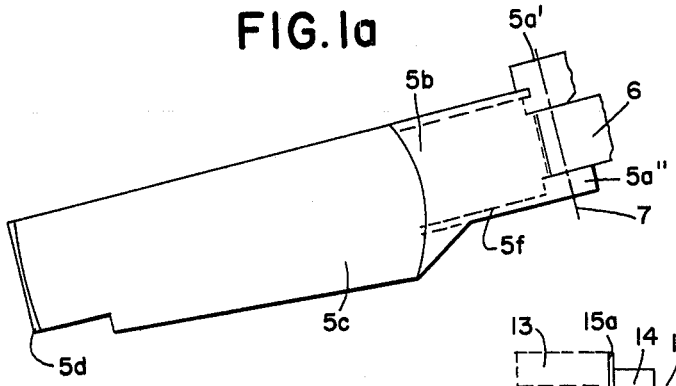
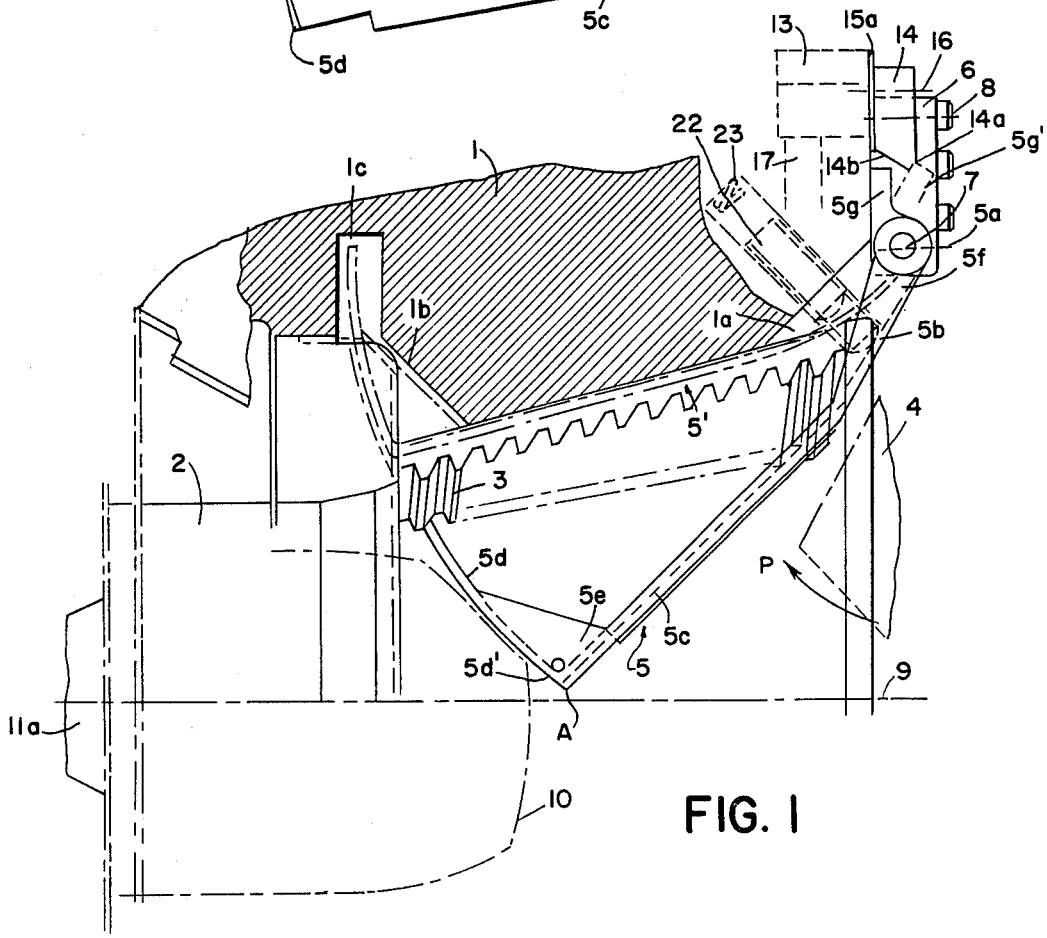
FIG. 1

DEVICE FOR STRIPPER

TECHNICAL FIELD

The present invention relates to a device for a stripper of a firearm, which can coact with a first ammunition unit, such as a powder charge, and which during an insertion process is arranged to permit insertion into the chamber of the firearm a second ammunition unit, such as a shell. During the insertion process the second ammunition unit is in front of the first ammunition unit, and also said first ammunition unit, and during an extraction process following the insertion process to enter into coaction with the first ammunition unit for retaining of the same in the chamber.

A a large-calibre firearm, e.g. a field howitzer is one type of firearm employing the invention.

BACKGROUND ART

It is previously known to utilize a stripper, by means of which a powder charge can be retained in the chamber during the extraction of the ramming unit.

DISCLOSURE OF THE INVENTION

TECHNICAL PROBLEM

In a rapid loading process with high ramming speeds for the shell and charge, it is important that no unintentional actuation of the fuze or the like can be applied at the front end of the shell. Such a risk could arise, for instance, by the front end of the shell striking the stripper during the ramming.

THE SOLUTION

The main purpose of the device according to the present invention is to solve the above-mentioned problem. in the new device, at least during the initial stage of the insertion process, the stripper can coact with blocking means which keeps the stripper in a turned-in position to prevent the first ammunition unit from striking the stripper during the insertion process. The ramming unit in a predetermined longitudinal displacement position is arranged to achieve a releasing of the blocking means, and the stripper during releasing is arranged to assume a turned-out position in order to enable coaction with the first ammunition unit. The stripper from its turned-out position can be actuated to its turned-in position by means of a closing mechanism of the firearm, and that at the turned-in position the blocking means can again be adjusted to keep the stripper in the turned-in position.

In further developments of the concept of the invention a more detailed design of the stripper itself and the parts coacting with the stripper are proposed.

In addition to avoiding an undesirable striking of the stripper by the shell or the like through the proposed arrangement, a solution is obtained which does not influence the loading function in other respects.

Further, a technically simple but nevertheless well functioning design of various parts is obtained.

BRIEF DESCRIPTION OF DRAWINGS

An embodiment of a device which has the characteristics significant for the invention will be described in the following, with reference to the accompanying drawings, in which FIG. 1 in a vertical section shows parts of a breech ring belonging to a firearm on which the new stripper and the blocking means belonging to it are arranged, FIG. 1*a* in a horizontal view shows the stripper from below, and FIG. 2 in a view from the rear shows the breech ring with stripper and blocking means according to FIG. 1.

BEST MODE OF CARRYING OUT THE INVENTION

Figure 2:
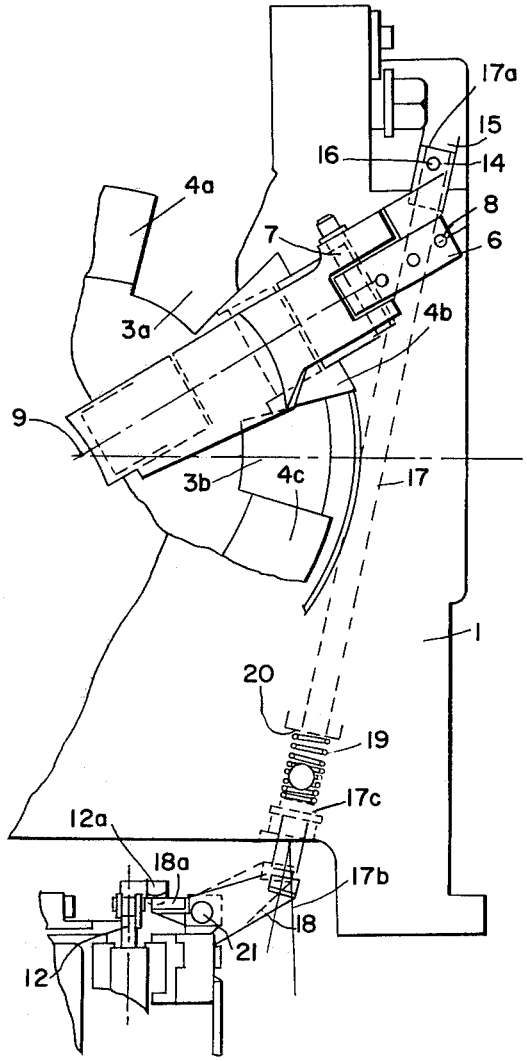

In FIG. 1, the numeral 1 shows the parts of a breech ring of a known large-calibre firearm. An example of the firearm is a field artillery piece in the form of a field howitzer. The chamber in the barrel is indicated by 2. The breech ring has conical screw threads 3, to which a screw 4 in a screw breech mechanism which is known can be applied and screwed with corresponding threads on the screw. The screw is then arranged so that it can be swung down in the direction of the arrow P in the breech ring at its upper edge to an end position in the longitudinal direction of the firearm, from which longitudinal end position the screw can be turned approx. 30°, so that its threads enter into coaction with the threads of the breech ring for securing of the screw to the breech ring. The threads on the screw and the breech ring, respectively, are then in a known way made with sections without threads around the periphery, to permit the screw to be swung down to the end position in the longitudinal direction. In FIG. 2, two threaded sections of the threads of the breech ring are shown by 3*a* and 3*b*, while three sections without threads are indicated by 4*a*, 4*b*, and 4*c*.

In one of the sectors without threads, the sector 4*b*, a stripper 5 is placed. The stripper has the form of an elongate, flat element which in its first end has a supporting part 5*a*, which transfers into a straight, comparatively short part 5*b*. The last-mentioned part is connected through a small angle to a straight main part 5*c* of the element. The part 5*c*, in turn, is connected to a slightly curved part 5*d* which is at an angle of approx. 90°, the curved form of which is then curved inwards. The parts 5*c* and 5*d* are connected to each other with side reinforcements 5*e*. Also the supporting part 5*a* and the part 5*b* have side reinforcements 5*f*.

Viewed from above, the parts are substantially of uniform width. In its mainly longitudinal extent the part 5*c* is wider than the parts 5*b* and 5*d*, and is narrowed at its front end so that its width at the narrowed part substantially conforms to the width of the parts 5*b* and 5*d*. The parts 5*b*, 5*c*, and 5*d* moreover have a common straight side. The various parts have thicknesses of approx. 4–5 mm, particularly approx. 4 mm. The supporting part 5*a* comprises two supporting lugs 5*a'*;*l and* 5*a''*, extending forwards, via which the stripper is supported on a fixed holder 6 in the breech ring, corresponding to the lugs. The supporting shaft is indicated by 7. At the supporting part 5*a*;*l the stripper also has a means* 5*g* which is fixed in relation to the other part of the stripper, and which at the turning of the stripper around the shaft 7 participates in the turning movement of the stripper. The holder is fastened to the breech ring via fastening means, e.g. in the form of three screws 8.

The stripper is arranged so that it can assume a turned-out position which is shown by solid lines in FIG. 1, and a turned-on position 5' which is shown by dot-dash lines in FIG. 1. At the turned-on position, the stripper is pressed down into the sector in question without threads, so that it does not extend up above the sectors with threads in the breech ring, and the stripper does not interfere with the closing movement of the screw. At the sectors without threads which are in the breech ring, the latter is made with recesses 1*a* and 1*b*, respectively, at the ends of the stripper, so that the stripper will be pressed down under the threads of the breech ring notwithstanding the side reinforcements 5*e* and 5*f*, which will be located in recesses in the turned-in position of the stripper. At the recess 1*b* there is also arranged a space 1*c* for the angular part 5*d* of the stripper.

In the turned-out position of the stripper the outer end A of the part 5*c* is located close to the axis 9 of the bore of the firearm, and the end A is also somewhat curved around the axis of the bore. The major portion of the stripper is thus turned obliquely forwards/downwards, viewed from the support 5*a*, and is directed substantially straight towards the charge, bag charge, powder bag, or other type of charge which is present in incomplete assembled round of ammunition.

In the turned-out position the stripper is intended to be capable of coacting with a charge 10 placed in a sack or corresponding material, via its slightly convex front surface 5*d*' on the front side of the angular part.

The stripper is arranged so that it permits insertion into the bore of the barrel and chamber a shell 11 or corresponding projectile placed in front of the charge 10. Further, the process of insertion of the shell and charge by means of a ramming unit, which in FIG. 2 is symbolized by 12, the stripper shall be in a turned-in position so that the front parts 11*a* of the shell or the like do not strike a hanging down stripper which even if it hangs down loosely could then damage or in some other way give rise to improper functioning of a fuze in the shell or the like, which by all means must be avoided. The fuze can then be located at an arbitrary place along the shell or the like.

In order that the stripper shall be in a turned-in position when at least said front parts 11*a* of the shell pass the position of the stripper it can coact with the blocking means described in the following, which can be released by means of the ramming unit 12 when it has moved the parts past the stripper. At the releasing of the blocking means the stripper can assume its turned-out position and go down behind the charge so that in an extraction process for the ramming unit following the insertion process it will prevent the charge from following the ramming unit out of the chamber. The ramming unit is here assumed to be well known in itself, and will therefore not be described in detail in this connection.

The blocking means comprise displaceable means 13 and 14, the means 14 then being guided in a groove 15 arranged in the breech ring or a part fastened in the breech ring. The displaceable means are fixed together by means of a securing means 16, but in principle can consist of one single integrated piece. At its front end, the displaceable means 14 has two surfaces 14*a* and 14*b*, directed obliquely forwards. In a first longitudinal displacement position (=the position according to FIG. 1) the means can coact via a surface 14*a* with an undersurface of the means 5*g* belonging to the stripper, when the last-mentioned means at the turned-in position of the stripper assumes an angular position 5*g*' in which the undersurface is turned away from the bottom surface 15*a* in the guide groove 15. In the first displacement position the means 14 forces the stripper to remain in its turned-in position.

The first longitudinal displacement position is determined by a blocking rod 17 also comprised in said blocking means, which extends over the cross section of the breech ring. In its one end 17*c* the rod is fastened in the displaceable means 13, and is fixed e.g. by means of a pin, screw, or other connection which can be disassembled. At its other end 17*b* the blocking rod 17 coacts with an actuating means 18 for the blocking rod, rotatably supported at the side of the breech ring. The blocking rod is also actuated by a helical spring 19, which strives to keep the rod longitudinally displaced towards the end 17*b*. The rod has a flange 17*c* with which the spring is in contact, and at its opposite end the spring is then in contact with a surface 20 on the breech ring.

The rotatable means 18 has a part 18*a* which is located in the longitudinal displacement path of the ramming unit. When the ramming unit passes the part 18*a* it actuates the part 18*a* by means of a part 12*a*, and the actuating means 18 then turns around an axis of rotation 21 and displaces the blocking rod longitudinally in the direction towards its first end 17*a* against the action of the spring 19. At the longitudinal displacement movement which then arises the displaceable means 13 is actuated which, in turn, carries along the means 14 so that the means 15*g* on the stripper is released. The stripper can then of its own weight drop to its turned-out position. However, in order to ensure that the stripper will be turned out, it can also coact with a pressing-out device which comprises a bar or pin 22 supported in a recess, which is constantly acted upon by a spring 23, which strives to keep the bar or pin in a pressed-out position. The bar or pin, in turn, is in contact with the inner surface of the part 5*b* of the stripper via its free end.

When the part 12*a* during the continued insertion process of the ramming unit passes the part 18*a*, the spring 19 can press the bar 17 to its starting position, and the displaceable means 13, 14, in turn, are then moved back to the starting position. When the means 5*g* at this stage has assumed a position where said undersurface of the means 5*g* is in contact with the rear surface 1*a* of the breech ring, the stripper is not actuated. Thus, through its coaction with said rear surface 15*a* the means 5*g* also determines the extent to which the stripper is turned out. The inclination of the surface 14*b* and the thickness of the means 5*g* at its front end are also chosen in such a way that movements, if any, of the means 14 are not prevented when the ramming unit during its extraction process following the insertion process via its part 12*a* achieves a renewed actuation of the rod 17, followed by movements back and forth of the displaceable means 13, 14. Alternatively, the actuation part 12*a* on the ramming unit can be made so that actuation takes place only during the insertion process, and not during the extraction process, and the last-mentioned extra actuations in the blocking means will not take place.

Thus, when the stripper has assumed its turned-out position, it can achieve its stripping function of the charge 10. When the extraction process of the ramming unit has been completed, the screw 4 is closed. During the closing process the stripper is pressed down into the sectors in question without threads, through coaction with the screw and with the closing force. The means 5*g* is then turned upwards and goes into coaction with the oblique surface 14*b* of the means 14 and achieves a displacement of the displaceable means 13, 14 which, in turn, displace the blocking rod 17 longitudinally against the action of the spring 19. As soon as the means 5*g* has been pressed down over the common end edge of the surfaces 14*a* and 14*b* the spring 19 can press the rod back and force the surface 14*a* on the means 14 under the undersurface of the means 5*g* on the stripper.

The invention is not limited to the embodiment shown above as an example, but can be subject to modifications within the scope of the following claims.

INDUSTRIAL APPLICABILITY

The new device consists of a relatively few and simple parts, which can be manufactured at a low cost and integrated with the firearm in efficient manufacture. Also firearms which have been manufactured can be provided with the new facility.

We claim:

1. In a firearm having a chamber for receiving a shell and powder charge, a ramming unit for inserting said shell and powder charge in said chamber, a threaded breech ring and closing screw for maintaining said chamber closed, the improvement comprising:

an elongated stripper for holding the powder charge in the chamber during extraction of said ramming unit, said stripper being connected at one end to swing from a first charge holding position to a second position for maintaining said stripper from striking said powder charge;

a blocking means for maintaining said stripper in said second position until said ramming unit moves said shell and powder charge into said chamber including a longitudinal blocking rod having at one end thereof an actuator for longitudinally displacing said rod in response to movement of said ramming unit, and a displacement means connecting said stripper with a remaining end of said blocking rod, whereby motion of said rod releases said stripper from said second position to assume said first position under the influence of a spring force against said stripper; and, means for moving said stripper from said first position to said second position in response to closing said screw with said breech ring whereby said stripper is maintained in place avoiding contact with a subsequent shell and powder charge.

2. A device according to claim 1, said closing screw, having threads which can coact with corresponding threads in the breech ring of the firearm, the threads of the screw and the threads of the breech ring including sectors without threads, to enable the screw to be swung down to an end position in the longitudinal displacement direction so that from said end position the screw can be turned for securing to the breech ring, and the stripper has the form of an elongate flat element with comparatively little thickness and is applied at one end of said sectors without threads.

3. The firearm of claim 1 wherein said breech ring includes a recess, and said stripper is positioned in said recess in said second position.

4. A device according to claim 3, wherein the elongate stripper is rotatably supported at its first end and at its second end supports an angular part which can coact with the powder charge.

5. A firearm which discharges a powder charge in combination with a shell, said firearm having a chamber for receiving said shell and powder charge, further comprising:

a stripper having a first position for maintaining during extraction of a ramming unit from said chamber said powder charge in place, said stripper being movable to a second position for permitting insertion of said shell and powder charge during loading of a firearm which prevents said stripper from discharging said powder charge;

a longitudinal blocking rod having at one end thereof an actuator for longitudinally displacing said rod in response to movement of said ramming unit;

displacement means connecting said stripper with a remaining end of said blocking rod, whereby motion of said ramming unit displaces said blocking rod, and said displacement means maintains said stripper in said second position whereby said powder charge and shell may be inserted;

means for releasing said blocking means when said ramming unit moves said powder charge and shell into said chamber whereby said stripper under the action of a spring force moves to said first position for retaining said charge during extraction of said ramming unit; and means for closing said firearm chamber against said shell and powder charge, said means for closing coupled to said stripper for returning said stripper to said second position whereby a subsequent powder charge and shell may be inserted in said chamber.

6. A device according to claim 5, wherein the stripper has a middle part which is operated by the closing means, the closing means actuating the stripper from the first position to the second position against the action of the spring device.

7. A device according to claim 6, wherein the displacement means upon actuation of the stripper by the closing means is displaced by the stripper, and a returning movement of the blocking rod against the action of a spring cooperating with the blocking rod prepares the blocking rod and the displacement means for a renewed releasing actuation from the stripper.

* * * * *